US007639971B2

(12) United States Patent
Mathea

(10) Patent No.: US 7,639,971 B2
(45) Date of Patent: Dec. 29, 2009

(54) APPARATUS FOR THE ELECTROGRAPHIC PRINTING AND COPYING USING LIQUID COLORING AGENTS

(76) Inventor: Hans Mathea, Daimlerstr. 32a, D-76344 Eggenstein-Leopoldshafen (DE)

( * ) Notice: Subject to any disclaimer, the term of this patent is extended or adjusted under 35 U.S.C. 154(b) by 202 days.

(21) Appl. No.: 11/810,343

(22) Filed: Jun. 6, 2007

(65) Prior Publication Data

US 2007/0237550 A1 Oct. 11, 2007

Related U.S. Application Data

(63) Continuation-in-part of application No. PCT/DE2005/002281, filed on Dec. 19, 2005.

(30) Foreign Application Priority Data

Dec. 23, 2004 (DE) ..... 10 2004 061 961

(51) Int. Cl.
*G03G 15/10* (2006.01)

(52) U.S. Cl. ..... 399/237; 399/247; 399/249; 101/416.1; 101/425

(58) Field of Classification Search ..... 399/237, 399/247, 249; 101/416.1, 425
See application file for complete search history.

(56) References Cited

U.S. PATENT DOCUMENTS

| | | | | |
|---|---|---|---|---|
| 4,173,945 | A | | 11/1979 | McFarland |
| 4,784,080 | A | * | 11/1988 | Bibl et al. ..... 399/242 |
| 4,793,281 | A | | 12/1988 | Dobbins et al. |
| 5,157,443 | A | | 10/1992 | Anderson et al. |
| 5,502,551 | A | | 3/1996 | Bonino et al. |
| 5,708,936 | A | * | 1/1998 | Wang et al. ..... 399/239 |

FOREIGN PATENT DOCUMENTS

GB 2 243 227 10/1991

* cited by examiner

*Primary Examiner*—David M Gray
*Assistant Examiner*—G. M. Hyder
(74) *Attorney, Agent, or Firm*—Klaus J. Bach

(57) ABSTRACT

In an apparatus for the electrographic printing or copying using liquid coloring agents consisting of a carrier liquid and toner particles, including a latent image carrier and at least one supply element in the form of a slot-like supply nozzle via which the liquid toner is applied to the latent image carrier and a suction element by which excess liquid coloring agent is removed from the latent image carrier, a de-coupling channel is arranged between the suction element and the supply element.

8 Claims, 1 Drawing Sheet

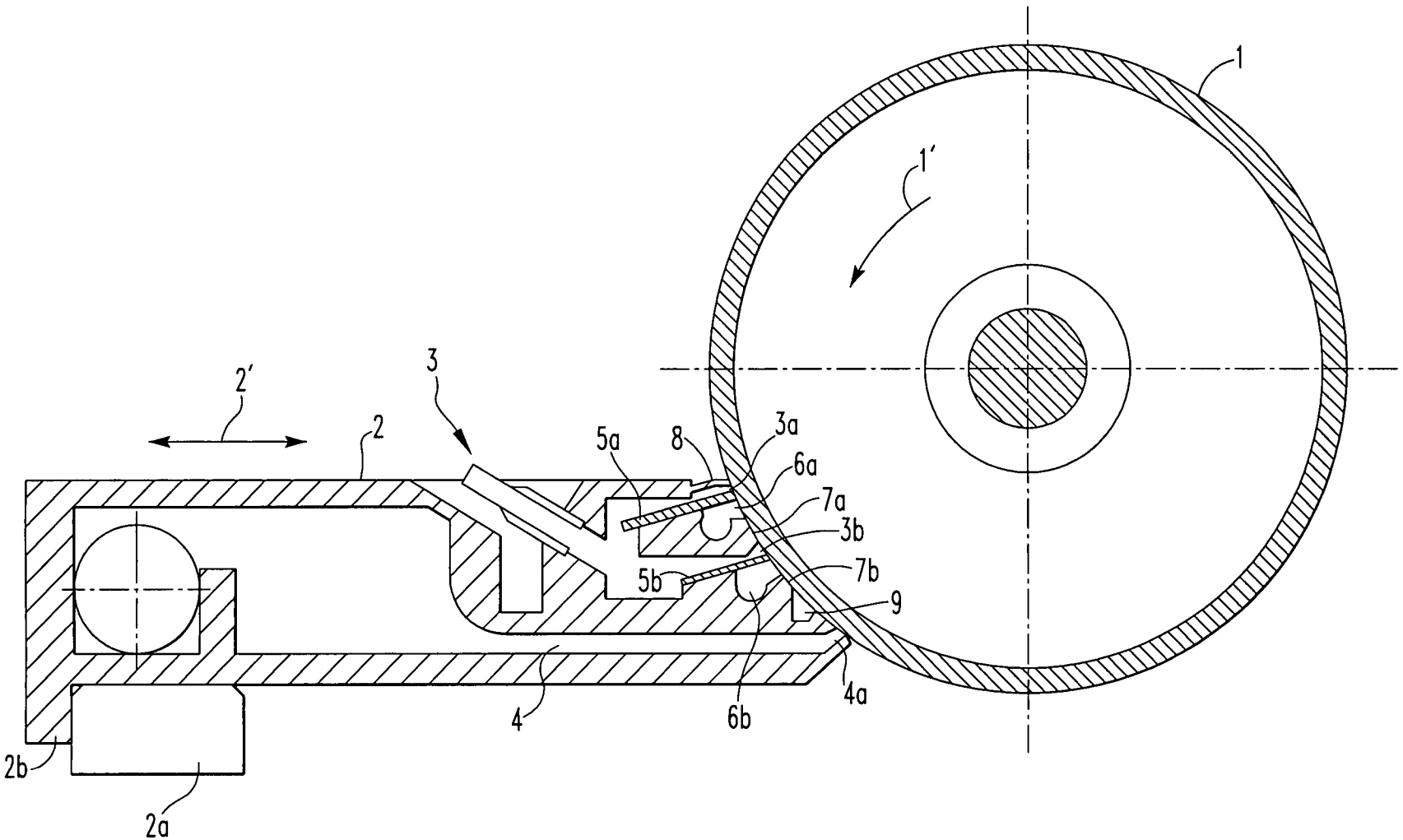
1
1'
3a
6a
7a
3b
7b
9
4a
6b
8
5b
5a
4
3
2
2'
2a
2b

APPARATUS FOR THE ELECTROGRAPHIC PRINTING AND COPYING USING LIQUID COLORING AGENTS

This is a Continuation-In-Part Application of International Application PCT/DE2005/002281 filed Dec. 19, 2005 and claiming the priority of German application 10 2004 061 961.1 filed Dec. 23, 2004.

BACKGROUND OF THE INVENTION

The invention resides in an apparatus for the electrographic printing and copying using liquid coloring agents, including a latent image carrier and a supply element having at least one slot-like supply nozzle via which the liquid coloring agent can be applied to the latent image carrier and a suction element for the removal of excess coloring agent from the latent image carrier.

Such an apparatus is known for example from GB 2 243 227 A. In this apparatus, liquid toner is applied to a latent image carrier in the form of an imaging drum. To this end, the apparatus includes a slot-like outlet via which liquid toner, pressurized by means of a pump is applied to the imaging drum. In the movement direction of the imaging drum behind the slot-like outlet, a slot-like inlet is arranged to which a vacuum is applied. In this way, toner which does not adhere to the imaging drum is sucked off the imaging drum. Between the outlet and the inlet, an electrode is arranged at a small distance from the surface of the imaging drum.

Since the inlet is arranged, in the direction of movement of the imaging drum, a small distance after the electrode, toner which is blocked by the electrode cannot be removed by the inlet. Although an excess passage is disposed, in the direction of movement of the imaging drum, before the outlet, only toner which is disposed at the side of the outlet remote from the electrode reaches the excess passage. Toner which adheres to the imaging drum cannot be taken up by the excess passage.

DE 32 30 862 A1 discloses an apparatus wherein, for the development of a charge image which is applied to an electrically coated image carrier, the image carrier is wetted by a liquid developer or, respectively, a coloring agent from a dispersing device or, respectively, by a carrier liquid and toner particles. By means of the charge image, a part of the toner adheres to the surface of the image carrier in the form of an image. The remaining toner is removed to prevent background coloring. Furthermore, dispersant is removed from the image carrier such that only so much dispersant remains on the image carrier that the developed charge picture can be properly and rapidly further treated. To this end, a removal member is provided which is moved relatively to the image carrier and whose surface is only very slightly immersed into the liquid developer disposed on the image carrier, so that part of the dispersant contained in the liquid developer is removed for example by adhesion. Furthermore, an electric field is applied between the removal device and the image carrier, whose field direction depends on the charge of the toner contained in the liquid developer. By this electric field, the toner which is not attached in the form of an image is removed by the removal device.

In the known apparatus, the liquid developer is applied to the image carrier by means of a separate element which is spatially separated from the removal device. Since also this element must be arranged at a correct distance from the image carrier, it is necessary to separately adjust the distance of the element from the image carrier and the distance of the removal device from the image carrier wherein particularly the distance of the removal device from the image carrier must be adjusted very accurately. This distance determines whether unnecessary toner or, respectively, excessive dispersant is removed from the image carrier with sufficient thoroughness.

DE 100 27 173 A1 further discloses an apparatus and a method for the electrographic printing and copying using liquid coloring agents which generally consist of a carrier fluid and toner particles. The apparatus includes an applicator element which carries a layer of a coloring agent. Between the liquid layer and the opposite surface of the latent image carrier, there is an air gap. For the coloring of the latent image on the image carrier, droplets are transferred from the liquid layer to the surface of the latent image carrier through the air gap. In this way, the latent image is inked so as to form a coloring agent image. This coloring agent image can then be transferred directly to a final image carrier which may consist for example of paper.

The apparatus may also include a cleaning station in which the latent image carrier is cleaned after the transfer of the coloring agent image that is, the residual carrier and a well-defined initial state is re-established. The cleaning station may include a suction device which sucks off the residual liquid coloring agents from the surface of the image carrier. The discharge air may be filtered and the liquid coloring agent may be precipitated for reuse in a later printing process.

U.S. Pat. No. 6,385,421 B1 discloses a printing apparatus which includes a latent image carrier in the form of an imaging drum. At the imaging drum, four development units are arranged by means of which liquid tones of different colors are applied to the imaging drum. The toner is applied by means of transfer drums which immerge on one hand into a reservoir which includes liquid toner and, on the other hand, come in contact with the surface of the latent image carrier.

In the direction of movement of the imaging drums behind the transfer drums, there is in each case a vacuum nozzle by way of which excess liquid toner is removed from the latent image carrier. With the use of drums for the transfer of the liquid toner to the latent image carrier however high printing speeds cannot be achieved.

EP 0 223 693 A2 finally discloses a plotter-toner station for an electrostatic printer which comprises a printing head and a developer unit attached to the printing head. By means of the printing head, a charge is applied to a final image carrier which typically consists of paper and which passes by the printing head. Following the printing head, the final image carrier passes the developer unit. The developer unit includes a drum by way of which toner is applied to the final image carrier. To this end, liquid toner is sprayed earlier onto the drum.

After the toner has been applied to the drum, the final image carrier passes by a vacuum chamber by means of which excess liquid toner is removed from the final image carrier. To this end, the vacuum chamber has openings via which toner disposed in areas of the final image carrier which are not provided with a charge, is sucked off the final image carrier.

With the transfer of the toner by a drum to the image carrier however no high printing speed can be achieved.

It is the object of the present invention to provide an apparatus for the electrographic printing and copying using liquid coloring agents, with which a high printing speed can be achieved and which requires a small apparatus height.

SUMMARY OF THE INVENTION

In an apparatus for the electrographic printing or copying using liquid coloring agents consisting of a carrier liquid and toner particles, including a latent image carrier and at least one supply element in the form of a slot-like supply nozzle via which the liquid toner can be applied to the latent image carrier and a suction element by which excess liquid coloring agent can be removed from the latent image carrier, a de-coupling channel is arranged between the suction element and the supply element.

Since the supply element is a slot-like supply nozzle and since below the supply element a return channel is arranged, the liquid coloring agent can be splashed onto the latent image carrier. Since the removal of the excess liquid coloring agent from the latent image carrier depends on the vacuum level of the suction device the vacuum level can be easily controlled so that essentially all of the excess liquid coloring agent can be removed from the latent image carrier without removal from the latent image carrier of any part of the coloring agent forming the image. This has a very advantageous effect on the quality of the print or copies generated by the apparatus.

It is very advantageous that, between the suction element and the supply element, a de-coupling channel is arranged. In this way, it is ensured that the suction device does not affect the supply element. The air ingested by the suction device from the direction of the supply element is provided fully by way of the decoupling channel so that the supply element is not affected by the suction.

In a particular embodiment of the invention, a wiper is arranged, in the direction of movement of the latent image carrier, after the supply nozzle and at a first predetermined distance from the latent image carrier. In this way, the amount of the excess liquid coloring agent adhering to the latent image carrier can be limited. Since the wiper however, is not intended to fully remove the excess coloring agent from the latent image carrier, it is arranged at a relatively large distance from the latent image carrier of about one to two tenths of a millimeter.

In this way, it is avoided that impurities contained in the liquid coloring agent such as small particles remain stuck in the gap between the wiper and the latent image carrier whereby the latent image carrier could be damaged. Furthermore, out-of-round areas or faulty concentric running of the image drum have no effect because of the relative large distance of the surface of the image drum from the wiper. Safety measures for avoiding that the wiper comes into contact with an out of round imaging drum or a non-concentric running image drum are therefore not needed.

It is also very advantageous if, in the direction of movement of the latent image carrier, ahead of the wiper, a return flow channel is arranged in such a way that the liquid coloring agent retained by the wiper reaches the return flow channel. In this way, the part of the splashed-on coloring agent which does not adhere to the latent image carrier is collected in the return flow channel which, advantageously, is in communication with the reservoir for the liquid coloring agent.

The return channels can be so designed or arranged that the developer unit is disposed at the side of the drum-like latent image carrier. This is very advantageous with respect to the required height of the apparatus which is particularly noticeable in connection with color printers or color copiers.

In a further advantageous embodiment of the invention, wherein the suction apparatus includes a nozzle opening formed in such a way that at least twice, particularly eight times and preferably ten times, the amount of air is sucked in from the direction remote from the supply element of the amount sucked in from the direction of the supply element. In this way, the particles of the dispersant leaving the suction device are again sucked into the suction device. By the suction, the particles can be atomized whereby the coloring agent image adhering to the latent image carrier is dried somewhat. By controlling the vacuum level therefore the drying degree of the coloring agent image on the latent image carrier can be adjusted. This is very advantageous since in some application it is necessary that the coloring agent image adhering to the latent image carrier is not completely dry.

Particularly advantageous is an embodiment of the invention which includes a limiting element by which the coloring agent supply volume of the supply element can be adjusted. In this way, an amount of coloring agent can be applied to the latent image carrier as it is needed for the production of a saturated coloring agent image. This permits to limit the need for the removal of an excessive amount of liquid coloring agent from the latent image carrier which amount should be kept as small as possible.

In another embodiment of the invention, the supply element and the removal element are arranged at a second predetermined distance from the latent image carrier in a developer unit which is releasably connected to the apparatus. In this way, the arrangement of the supply element and of the removal element on the latent image carrier is substantially simplified. Since the supply element and the removal element are fixed in the developer unit, in this embodiment only the developer unit has to be accurately arranged relative to the latent image carrier. This can advantageously be achieved by means of a stop which provides for an accurate and reproducible positioning of the developer unit.

With the firm, generally fixed, arrangement of the supply element and the removal element, the distance of the removal element from the supply element is also fixed. Consequently, the distance of the removal element from the supply element, especially after a removal of the developer unit from the latent image carrier, does not need to be re-adjusted so that the products provided by the apparatus are of uniform quality.

The advantages of the arrangement according to the invention are particularly apparent in connection with the servicing of the apparatus. Instead of the need for a separate removal and re-installation of the supply element and of the removal element only the developer unit has to be removed and re-installed and no time consuming adjustment work is necessary.

Further in accordance with the invention, elements consisting of a conductive material may be provided between the supply element and the removal element and at a fourth predetermined distance from the latent image carrier. With the elements of conductive material, the electric field between the developer unit and the latent image carrier can be extended in an advantageous manner. In this way, a good development of the coloring agent image on the latent image carrier is obtained. If a second supply element is provided the respective elements may consist of a conductive material. Expediently, the whole developer unit consists of a conductive material.

In still another embodiment of the invention, the developer unit is arranged at the side of a latent image carrier in the form of an image drum. In this way, several developer units may be arranged on top of one another without requiring an excessive apparatus height which is particularly advantageous in connection with color printers or color copiers. It is also advantageous that, for the application of the coloring agent to the imaging drum, the development of the latent image and the removal of the excess liquid coloring agent from the latent image carrier no movable parts are needed. With the suctioning off of the excessive coloring agent from the latent image carrier, a removal drum which rotates with the imaging drum is not needed. This is very advantageous since the removal drum arrangement next to the imaging drum is generally complicated and expensive since it must not come into contact with the imaging drum even if the drums are not perfectly round or are running off-centered.

The invention will become more readily apparent from the following description of a particular embodiment thereof with reference to the accompanying drawings.

BRIEF DESCRIPTION OF THE DRAWINGS

The sole FIGURE shows schematically an imaging drum with a developer unit disposed adjacent the imaging drum.

DESCRIPTION OF THE PREFERRED EMBODIMENT

As apparent from the FIGURE, a developer unit 2 is arranged adjacent a latent image carrier which is in the form of an imaging drum 1. The imaging drum 1 rotates in the direction of the arrow 1'. The developer unit consists of metal such as for example aluminum and is connected to a voltage source not shown in the FIGURE so that it has a potential of several hundred volts with respect to the imaging drum (about four hundred to seven hundred volts).

At its end adjacent an imaging drum 1, a developer unit 2 disposed adjacent the imaging drum 1 includes a supply element with a slot-like supply nozzle 3*a*. The supply nozzle 3*a* is formed by a top wall 8 of the developer unit 2 and a plate 5*a* which is slidable in the direction toward the imaging drum 1. With the plate 5*a*, the amount of coloring agent which is supplied to the surface of the imaging drum 1 by way of the supply nozzle 3*a* and which consists of a carrier liquid and toner particles, can be adjusted. Depending on the distance of the plate 5*a* from the imaging drum, this amount is larger or smaller. The distance of the plate 5*a* from the imaging drum 1 is so adjusted that the latent image present on the imaging drum 1 forms a saturated coloring agent image.

Below the plate 5*a*, there is a return flow channel 6*a* in which coloring agent which does not adhere to the imaging drum 1 is collected. The return flow channel is in communication with the coloring agent reservoir so that the coloring agent collected by the return flow channel 6*a* can be reused and again supplied to the imaging drum 1.

The wall 7*a* of the return flow channel 6*a* adjacent the imaging drum 1 is so formed that it extends in the direction of rotation 1' of the imaging drum 1 over an area of a few centimeters at a distance of about 0.2 mm from the surface of the imaging drum 1. In this way, it forms a wiper 7*a* which limits the thickness of the coloring agent adhering to the imaging drum 1 to about 0.2 mm. The excess part of the coloring agent is retained by the wiper 7*a* and is collected in the return flow channel 6*a*.

Below the return flow channel 6*a*, there is a second supply nozzle 3*b*, which is formed by the wall of the return flow channel 6*a* and a second plate 5*b*. The second plate 5*b* is also slidable toward the imaging drum 1. furthermore, below the second supply nozzle 3*b*, there is a second return flow channel 6*b* whose wall facing the imaging drum 1 forms a second wiper 7*b* which also limits the thickness of the coloring agent adhering to the imaging drum to about 0.2 mm.

With the arrangement of a second supply nozzle 3*b* and a second return flow channel 6*b*, it is ensured that a saturated coloring agent image is formed on the latent imaging drums in any case. If this can be achieved with only the first supply nozzle 3*a*, there is of course no need for providing the second supply nozzle 3*b* and the second return flow channel 6*b*.

At the lower end of the developer unit 2, a vacuum channel 4 is provided which has an opening 4*a* via which excess coloring agent can be sucked off the imaging drum 1. The vacuum in the vacuum channel 4 is adjustable so that a vacuum can be provided at which essentially all excess parts of the liquid coloring agent can be removed from the imaging drum but any part forming the coloring agent image remains adhering to the imaging drum 1. The opening 4*a* of the vacuum channel 4 is so formed that most of the air sucked in by the vacuum channel 4 enters the channel 4 from the side remote from the supply nozzle 3*a*. That means that the air sucked into the channel 4 flows through a gap which is formed by the lower wall of the developer unit 2 and the surface of the imaging drum 1. As a result, excess liquid still adhering to the imaging drum 1 is atomized and carried away.

To avoid that air is sucked in by the channel 4 from the direction of the supply nozzles 3*a*, 3*b*, an uncoupling channel 9 is disposed below the second return flow channel 6*b*. Both ends of the uncoupling channel 9 are open so that ambient air can enter the uncoupling channel 9 uninhibitedly.

The developer unit 2 is arranged in a guide structure, which is not shown in the FIGURE, in such a way that it can be easily removed from the imaging drum or installed adjacent the imaging drum. For this purpose, the developer unit 2 is moved in the direction of the arrow 2'.

For the adjustment of the distance of the developer unit and, together therewith, particularly of the first plate 5*a* and of the second plate 5*b* and also of the wipers 7*a* and 7*b* from the imaging drum 1, a stop 2*a* is provided against which a shoulder 2*b* of the developer unit 2 abuts. As a result of the guide and the stop 2*a*, the developer unit 2 is easily arranged relative to the imaging drum with high position-accuracy.

Since the curvature of the front side of the developer unit 2 is adapted to the curvature of the imaging drum 1, the developer unit 2 can be arranged at the side of the imaging drum 1. In this way, the construction height of the apparatus is small so that several developer units can be arranged on top of one another as it is often the case for example in color printers or color copiers.

What is claimed is:

1. Apparatus for the electrographic printing or copying using liquid coloring agents, comprising:

a latent image carrier (1), a coloring agent supply element (3) disposed adjacent the latent image carrier (1) including a slot-like application nozzle (3*a*, 3*b*) via which the liquid coloring agent is applied to the latent image carrier (1), a removal device (4) arranged adjacent the image carrier (1) and in the direction of rotation of the image carrier (1), closely adjacent the coloring agent supply nozzle (3*a*, 3*b*), a return flow channel (6*a*, 6*b*), a final excess coloring agent removal element (4) with a suction nozzle (4*a*) arranged adjacent the image carrier (1) in spaced relationship from the return flow channel (6*a*, 6*b*) for removing excess coloring agent therefrom and an uncoupling element (9) arranged between a nozzle (4*a*) of the excess coloring agent removal elements (4) and the coloring agent return channel (6*a*, 6*b*) and being in open communication with the ambient for uncoupling the excess coloring agent removal element (4) from the return flow channel (6*a*, 6*b*).

2. The apparatus according to claim 1, wherein, in the direction of rotation (1') of the latent image carrier (1) after the application nozzle (3*a*, 3*b*), a wiper element (7*a*, 7*b*) is arranged at a predetermined distance from the latent image carrier (1).

3. The apparatus according to claim 2, wherein, in the direction of rotation (1') of the latent image carrier (1) in front of wiper element (7*a*, 7*b*), a return flow channel (6*a*, 6*b*) is so arranged that liquid coloring agent retained by the wiper (7*a*, 7*b*) is deposited in the return flow channel (6*a*, 6*b*).

4. The apparatus according to claim 1, wherein a limiting element (5*a*, 5*b*) is provided by which the amount of coloring agent applied to the image carrier (1) by the supply element (3) is adjustable.

5. The apparatus according to claim 1, wherein the supply element (3) and the removal element (4) are arranged at a predetermined distance from each other in a developer unit (2) which is releasably connected to the apparatus.

6. The apparatus according to claim 5, wherein a stop member (2*a*) is provided which provides for a predetermined position of the developer unit (2) relative to the latent image carrier (1).

7. The apparatus according to claim 1, wherein the removal element (4) includes an elongated nozzle opening (4*a*) with upper and lower nozzle walls of which the lower nozzle wall is arranged at a greater distance from the image carrier (1) so that a substantially larger amount of air is sucked into the nozzle opening (4*a*) from a direction facing away from the supply element (3*a*, 3*b*) than is sucked in from the direction facing the supply element (3*a*, 3*b*).

8. The apparatus according to claim 1, wherein between the supply element (3) and the removal element (4) wiper and applicator elements (5*a*, 7*a*, 5*b*, 7*b*) consisting of a conductive material are arranged at a predetermined distance from the latent image carrier (1).

* * * * *